United States Patent [19]

Kilby

[11] Patent Number: 4,558,531

[45] Date of Patent: Dec. 17, 1985

[54] BENCH REST FOR FIREARMS

[76] Inventor: Gregory G. Kilby, 9068 Ball St., Plymouth, Mich. 48170

[21] Appl. No.: 557,828

[22] Filed: Dec. 5, 1983

[51] Int. Cl.[4] ..... F41C 29/00

[52] U.S. Cl. ..... 42/94

[58] Field of Search ..... 42/94; 89/37 BA

[56] References Cited

U.S. PATENT DOCUMENTS

| | | | |
|---|---|---|---|
| 3,012,350 | 12/1961 | Wold | 42/94 |
| 3,711,984 | 1/1973 | Dyer et al. | 42/94 |
| 4,055,017 | 10/1977 | Thompson | 42/94 |
| 4,207,699 | 6/1980 | Hensley | 42/94 |
| 4,449,314 | 5/1984 | Sorensen | 42/94 |

*Primary Examiner*—Charles T. Jordan

*Attorney, Agent, or Firm*—Reising, Ethington, Barnard, Perry & Milton

[57] ABSTRACT

A weapon bench rest (10) including a base (12) and a pair of spaced upright guide members (18) extending upwardly from the top side (14) of the base. A bridge (20) extends between the guide members (18) parallel to the top side (14) of the base and presents a weapon support surface (22) including a resilient pad (64) on the top (24) of the bridge. A height adjustment mechanism (26) incrementally adjusts and then arrestably maintains the distance between the weapon support surface (22) and the base (12). The base (12) is provided with a handle (40) and is supported by legs (42) the projecting length of which is adjustable and removable for storage within a suitable compartment (50) of the base.

10 Claims, 4 Drawing Figures

BENCH REST FOR FIREARMS

TECHNICAL FIELD

The subject invention relates to a bench rest assembly of the type for supporting a weapon such as a firearm in a fixed position during firing. More specifically, the instant invention includes a bridge mounted on a base and having a weapon support surface on which the barrel of a weapon such as a rifle may be rested.

BACKGROUND OF THE INVENTION

Prior art weapon bench rests have included generally immovable structures for supporting a weapon during aiming and firing. Where the weapon is being fired in a firing range, there is usually a series of weapon rests each positioned in front of its respective target and incorporated into a larger, bulkier supporting structure such as a wall or barrier. Another environment of use is a shooting gallery common in amusement parks; there, the weapon is pivotally secured to some type of vertical means of support so that the weapon may be swiveled in a wide variety of directions to track a moving target. This same type of swiveling action is common to stands used for military automatic submachine guns. A very different environment is presented while hunting wild game, making it unfeasible to transport a bulky support structure in order to have the benefit of a field weapon rest. Accordingly, choices are limited while hunting in the field, either the bough of a tree, a stump, or the hand of the hunter must be employed to steady the aim taken on the target.

The above weapon rests did not usually allow the weapon to be fired from a level position, such as when the barrel of a rifle is parallel to the ground. This limitation resulted in the weapon being used as a lever while taking aim, that is to say that the weapon support was used as a fulcrum while the marksman raised or lowered the stock of the weapon in order to align the sight with the target. Hence, the discharge end of the weapon was either pointing up or down toward the target, creating more problems of accuracy than would a weapon which was oriented parallel to the ground. There is a need for a portable and easily positioned weapon rest.

STATEMENT OF INVENTION AND ADVANTAGES

According to the present invention, there is provided an assembly comprising a base, a pair of spaced upright guide means extending upwardly from the top side of the base, a bridge extending between the guide means parallel to the top side of the base and presenting a weapon support surface on the top of the bridge. The assembly is characterized by height adjustment means for incrementally adjusting the distance between the weapon support surface of the bridge and the base.

The problems associated with firing upwardly or downwardly at a target are not encountered in accordance with the subject invention. Also, the problem of a portable and reliable bench rest while hunting wild game is solved using the subject invention. The invention may be used in any environment where a weapon such as a pistol, rifle or crossbow is to be fired. Particularly with respect to a handgun (pistol), a separate pistol butt rest is provided on the base for support and shock absorption, as well as protection of the base against abrasion. The lightweight assembly has a convenient built-in handle and the weapon support surface is adjustable in height so that the orientation of the weapon more closely parallels the ground. Hence, the trajectory of the projectile may be varied by precisely adjusting the height of the support surface rather than manual movement of the weapon by the marksman.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
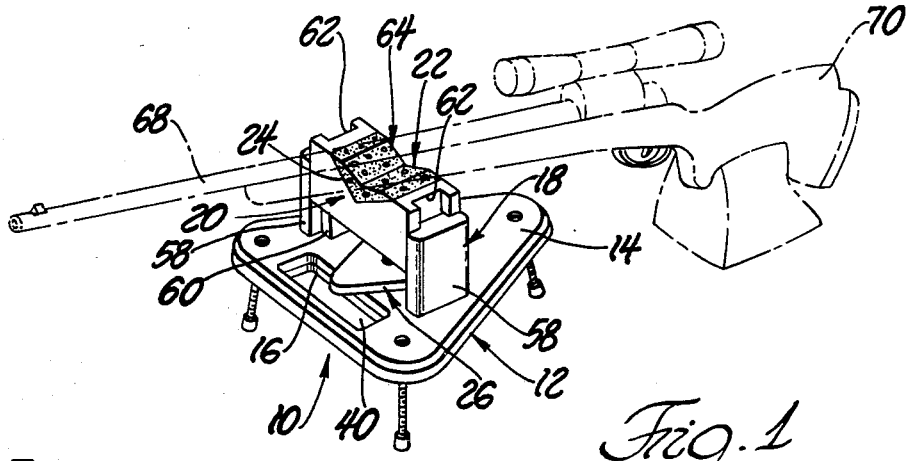
FIG. 1 is a perspective view of the weapon bench rest assembly of the subject invention illustrating its use with a rifle.
Figure 3:
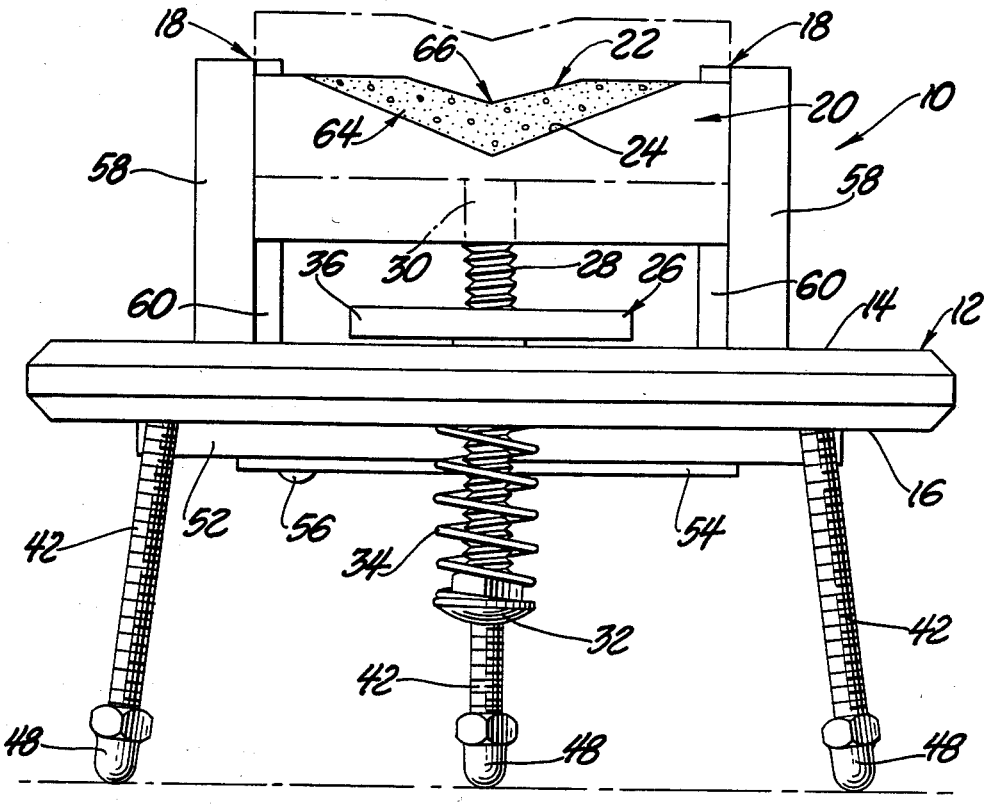
FIG. 3 is a view taken substantially along the lines 3—3 of FIG. 2.
Figure 4:
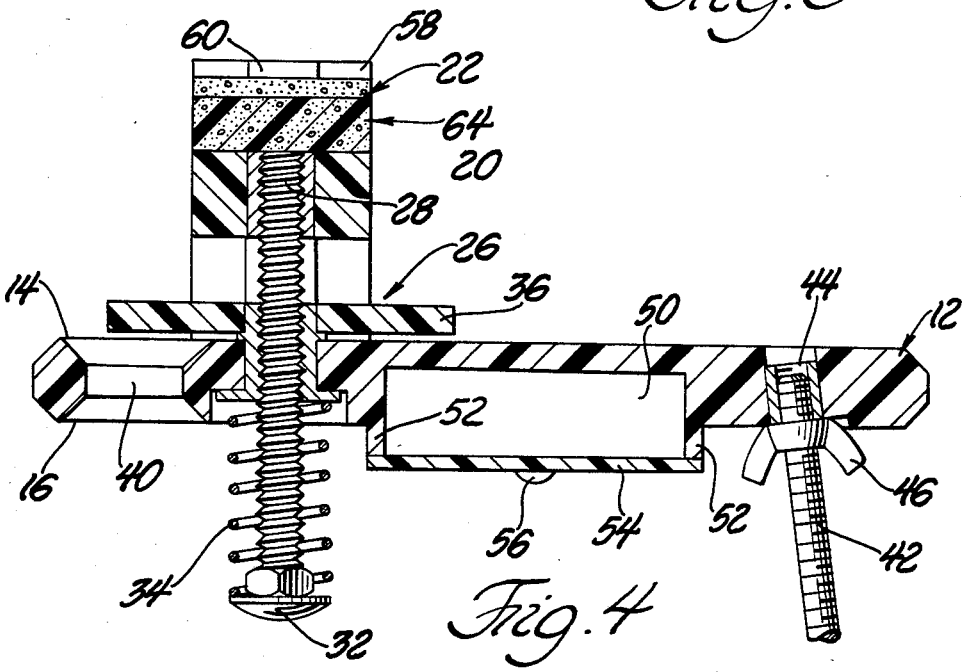
FIG. 4 is a cross-sectional view taken substantially along lines 4—4 of FIG. 2.

A weapon bench rest assembly of the type for supporting a weapon during firing is generally shown at 10 in FIGS. 1 and 3. As shown in FIG. 1, the assembly 10 includes a base generally indicated at 12 having top 14 and bottom 16 sides. A pair of spaced upright guide means generally indicated at 18 in FIGS. 1 and 3, extend upwardly from the top side 14 of the base 12. A bridge 20 extends between the guide means 18 parallel to the top side 14 and presents a weapon support surface generally indicated at 22 in FIGS. 1, 3 and 4, on the top 24 of the bridge 20.

The assembly 10 includes height adjustment means, generally shown at 26, for adjusting and maintaining the distance between the weapon support surface 22 and the top 14 of the base 12. The height adjustment means 26 further includes a ram 28 (FIGS. 3 and 4), such as a carriage bolt, fixed to the bridge 20 at one end 30 of the ram 28 and manually movable toward the base at the free end 32 of the ram 28. A biasing means 34, such as a spring, is associated with the ram 28 between the free end 32 thereof and the bottom side 16 of the base 12, urging the free end 32 outwardly away from the bottom side 16. A diamond-shaped height adjuster member 36 includes an aperture 38 (shown in FIG. 2) which threadedly engages the ram 28, limiting the retraction of the free end 32 away from the base. By turning the diamond height adjuster 36, the free end 32 may be moved toward or away from the base resulting in the weapon support surface 22 also being moved toward or away from the base, the aforesaid defining incremental positioning means. Alternatively, the free end 32 may be manually pushed up toward the base and the diamond height adjuster 36 spun around to arrest the ram 28 in the position to which it has been pushed; this feature may be used when larger height adjustments are desired. It will also be appreciated by those skilled in the art that other alternative means, e.g. a friction brake, may be employed to incrementally adjust the retraction of the ram.

Figure 2:
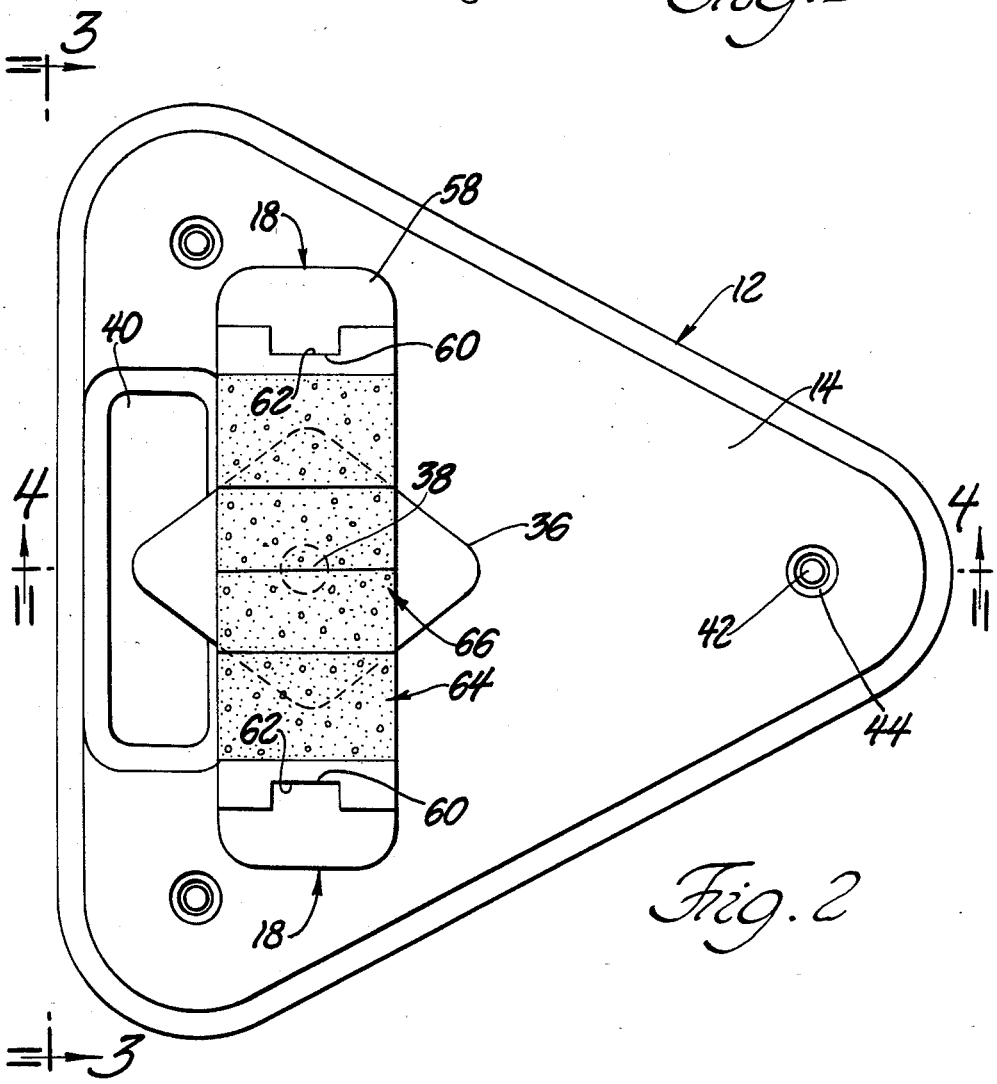
FIG. 2 is a top plan view of the subject assembly.

With reference to FIGS. 1 and 2, the base 12 has a preferably triangular configuration, although it will be appreciated that other shapes may be utilized. A handle opening 40 is provided in the base 12 for easy carriage of the assembly 10. It should be noted that the handle opening 40 is elongated in a direction parallel to one of the sides of the triangular base 12 and also parallel to the weapon support surface 22, i.e., the opening 40 is positioned between the guide means 18 and said side. The assembly 10 is constructed of a durable material, preferably wood, to render it lightweight and easily carried using the handle 40, and also a poor heat conductor for temperature stability.

The base 12 is supported by a plurality of threaded legs 42, i.e., bolts, each threadedly engaging a threaded bushing fixed in an aperture 44 extending through the base 12. The legs 42 are secured in position by wing nuts 46, all of which define length adjustment means. By loosening the wing nuts 46 the legs 42 may be turned to screw into and out of the threaded bushings to vary the length the legs 42 extend from the bottom side 16. A soft cap 48 of a material such as plastisol, is fitted over the free end of each leg 42, providing a cushioning contact with the surface upon which the legs rest. Optionally, longer threaded legs may be used (not shown) to provide a weapon support surface which may be used while the marksman is in a standing, sitting or kneeling position while the end caps 48 rest on the ground. The legs 42 shown in the assembly of FIGS. 1 and 3 may be removed by loosening the wing nut 46 and backing the legs out of the threaded aperture 44 in the base. Once removed, the legs may be stored within a sufficiently sized compartment 50 of the base (shown in cross section in FIG. 4). The compartment 50 is formed from a cavity in the base 12 and is provided with additional depth by extension or spacer walls 52 extending from or mounted to the bottom 16 of the base. A door 54 is pivotally attached to the spacer 52 by a screw 56 allowing the door to be pushed aside for storage and removal of the legs.

The guide means 18 comprises a pair of spaced upright posts 58 each having a male projection 60 received within a complementary recess 62 formed along either side of the bridge 20. Turning of the height adjuster 36 or alternatively, manual movement of the free end 32 of the ram 28 toward the bottom side 16 of the base 12, raises and/or lowers the bridge 20 guided within the slidable tongue-in-groove connection defined by the projections 60 sliding in grooves or recesses 62.

The weapon support surface 22 is characterized by a resilient pad generally indicated at 64 made of a foam having shape-memory qualities allowing the resilient pad 64 to absorb much of the recoil shock of firing while returning to its initial position, eliminating any need for height readjustment after firing. The resilient pad 64 has a contour corresponding to the top 24 of the bridge 20 so that a corresponding recess generally indicated at 66 in the resilient pad 22 is provided for centering the barrel 68 of a firearm 70 as illustrated in FIG. 1. The recess 66 also readily allows the barrel 68 to be recentered after firing. Additional shock absorption means (not shown) is provided on the top side 14 of the base 12 typically in the form of a resilient butt-rest pad upon which a pistol butt may be rested during firing; this also protects the wood finish and gun stocks from mars and scratches.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A weapon bench rest (10) comprising: a base (12) having top (14) and bottom (16) sides; a pair of spaced upright guide means (18) extending upwardly from the top side (14) of said base (12); a bridge (20) extending between said guide means (18) parallel to said top side (14) presenting a weapon support surface (22) at the top (24) thereof; height adjustment means (26) for incrementally adjusting the distance between said weapon support surface (22) of said bridge (20) and said base (12); a plurality of detachable legs (42) extending outwardly from said bottom side (16) of said base (12) for supporting said base, said base (12) having a generally triangular configuration; and a handle (40) formed by an opening in said base (12).

2. An assembly as set forth in claim 1 further characterized by including length adjustment means for adjusting the length said legs (42) extend from said bottom side (16) and locking means (46) for maintaining said adjustment.

3. An assembly as set forth in claim 1 further characterized by a compartment (50) included in said base (12) and capable of storing said legs (42).

4. An assembly as set forth in claim 3 further characterized by said legs (42) having a length capable of storage in said compartment (50).

5. An assembly as set forth in claim 1 further characterized by said height adjustment means (26) including a ram (28) fixed to said bridge (20) at one end (30) thereof and provided with incremental positioning means for incrementally adjusting the position of said ram (28) relative to said base (12).

6. An assembly as set forth in claim 5 further characterized by said incremental positioning means including a rotating member (36) threadedly engaging said ram (28) and arrestably varying the position thereof relative to said base (12).

7. An assembly as set forth in claim 6 further characterized by said height adjustment means including biasing means (34) for urging said ram (28) outwardly away from said bottom side (16) of said base (12).

8. An assembly as set forth in claim 7 further characterized by said ram terminating in a free end (32) opposite said one end (30), said free end (32) being manually movable toward said bottom side (16) to raise said bridge (20) relative to said base (12) as said rotating member (36) is moved outwardly from said top side (14) and against said biasing means (34).

9. An assembly as set forth in claim 1 further characterized by a resilient pad (64) mounted on said weapon support surface (22).

10. An assembly as set forth in claim 1 further characterized by removable legs (42) threaded along their length and threadedly engaging an aperture (44) extending through the base (12); a leg storage compartment (50) included in said triangular base (12) and capable of storing said legs (42); each of said guide means including a projection (60) therealong sliding in grooves (62) formed in said bridge (20); said height adjustment means (26) including a ram (28) and biasing means (34) for urging said ram (28) outwardly away from said bottom side (16) of said base (12) and a rotating member (36) threadedly engaging said ram (28) and arrestably varying the position thereof relative to said base (12).

* * * * *